US008555562B2

(12) United States Patent
Warner et al.

(10) Patent No.: US 8,555,562 B2
(45) Date of Patent: Oct. 15, 2013

(54) LOCKING JACK FOR A WINDOW WELL COVER

(75) Inventors: Vince S. Warner, Alpine, UT (US); David Ruff, Highland, UT (US)

(73) Assignee: David Ruff, Highland, UT (US)

( * ) Notice: Subject to any disclaimer, the term of this patent is extended or adjusted under 35 U.S.C. 154(b) by 314 days.

(21) Appl. No.: 12/826,514

(22) Filed: Jun. 29, 2010

(65) Prior Publication Data

US 2011/0314743 A1 Dec. 29, 2011

(51) Int. Cl.

| | |
|---|---|
| ***E02D 29/14*** | (2006.01) |
| ***E04F 17/06*** | (2006.01) |
| ***E06B 5/02*** | (2006.01) |
| ***E05F 11/24*** | (2006.01) |
| ***E05F 11/28*** | (2006.01) |
| ***E05D 13/00*** | (2006.01) |
| ***E05C 17/32*** | (2006.01) |

(52) U.S. Cl.
USPC ..... 52/107; 52/19; 52/20; 49/339; 49/345; 49/459; 292/263

(58) Field of Classification Search
USPC ..... 52/19, 20, 107, 64, 66, 122.1; 49/339, 49/345, 358, 359; 254/131, 131.5, 120, 254/113; 292/262, 263, 269
See application file for complete search history.

(56) References Cited

U.S. PATENT DOCUMENTS

| | | | | |
|---|---|---|---|---|
| 491,665 | A | 2/1893 | Rusing et al. | |
| 568,271 | A * | 9/1896 | Parsons | 49/345 |
| 574,371 | A | 1/1897 | Ault | |
| 823,195 | A * | 6/1906 | Sperry | 49/345 |
| 1,192,028 | A * | 7/1916 | Arzberger | 49/345 |
| 1,283,555 | A | 11/1918 | Pond | |
| 1,432,784 | A * | 10/1922 | Putnam | 292/263 |
| 2,093,036 | A | 9/1937 | Dickason | |
| 2,137,751 | A * | 11/1938 | Davis | 52/19 |
| 2,521,383 | A | 9/1950 | Malachowski | |

(Continued)

FOREIGN PATENT DOCUMENTS

JP 02047467 A * 2/1990

OTHER PUBLICATIONS

Coverwell, Inc, Webpage, Center hinging well cover, http://www.coverwell.com/products/window-well-products/center-hinging/, retrieved Jun. 24, 2010, dated through archive.org to Apr. 2007.

(Continued)

*Primary Examiner* — Josh Michener
*Assistant Examiner* — Ryan Kwiecinski
(74) *Attorney, Agent, or Firm* — Geoffrey E. Dobbin; Dobbin IP Law P.C.

(57) ABSTRACT

A window well cover jack is disclosed. The window well cover jack has three arms: a base arm, a support arm and an actuator handle, all connected to aid in the lifting of a window well cover and to allow egress. In one embodiment, the jack is lockable in a stowed position. It is also possible to add a spring assist to aid in the lifting of a window well cover. Ideally, the window well cover jack is also lockable in a deployed position to aid in holding an ajar window well cover so as to facilitate escape. A simple link, which is easily broken by emergency crews with the proper tools but secure against intruders without said tools, connects the window well cover jack to a window well cover.

10 Claims, 4 Drawing Sheets

(56) References Cited

U.S. PATENT DOCUMENTS

| | | | | |
|---|---|---|---|---|
| 2,725,003 | A | 11/1955 | Lyons | |
| 2,763,169 | A | 9/1956 | Mancino | |
| 3,331,586 | A | 7/1967 | Primoff | |
| 3,392,658 | A * | 7/1968 | Korff | 454/362 |
| 3,896,595 | A * | 7/1975 | Anghinetti et al. | 52/19 |
| 4,638,596 | A | 1/1987 | Gallardo | |
| 5,339,579 | A | 8/1994 | Woodyer et al. | |
| 5,735,086 | A * | 4/1998 | Fordahl | 52/19 |
| 5,788,406 | A * | 8/1998 | Hernandez | 404/25 |
| 6,000,071 | A * | 12/1999 | Fettes | 4/498 |
| 6,766,616 | B2 * | 7/2004 | Richter | 49/345 |
| 6,810,629 | B1 | 11/2004 | Hughes | |
| 7,444,784 | B2 | 11/2008 | Brown | |
| 8,091,292 | B1 * | 1/2012 | Jalbert | 52/107 |
| 2002/0144464 | A1 * | 10/2002 | De Marco | 49/339 |
| 2008/0034673 | A1 | 2/2008 | Tran | |
| 2009/0199490 | A1 * | 8/2009 | Hockham | 52/20 |
| 2009/0265996 | A1 | 10/2009 | Flory | |
| 2011/0203194 | A1 * | 8/2011 | Kelsch et al. | 52/69 |

OTHER PUBLICATIONS

Dyne, Inc, SAF-T Lock, www.windowwell.com/newlockpopup.htm, retrieved Jun. 24, 2010, dated through archive.org to 2008.

A-1 Fiberglass, SunEgress webpage, www.sunegress.com, retrieved May 26, 2010, dates through archive.org to 2008.

Jalbert, Steve, "Grate Escape" brochure. Believed to be 2007 (netsol.com dates website to Mar. 2007).

* cited by examiner

LOCKING JACK FOR A WINDOW WELL COVER

FIELD OF THE INVENTION

The present invention relates to the field of home security and more particularly relates to a lockable jack for the lifting of window well covers.

BACKGROUND OF THE INVENTION

Basement windows are required by law to allow for emergency egress if the room in which they are situated is used as a living area. This makes sense in an effort to save lives. However, when complying with this mandate, a builder must leave a gaping hole, or well, around the window on the outside. This presents a hazard as people, animals or objects may then fall into the window well. Covers have been developed to address this issue. Window well covers are usually a metal grate or a solid plastic, metal or wood cover that is positioned over the well. These covers must not hinder egress and must be removable by someone positioned inside the window without the use of special tools or effort.

Window well covers must also be easily lifted. Unfortunately current covers, in particular metal grates, meet the maximum standards required for weight, which means they can still be difficult for the elderly or young to lift. This is especially true as the cover must be either held above the escapee's head as they escape or physically moved to one side or another, likewise above the escapee's head. Various window well cover designs have been developed that are spring or shock biased to aid in the lifting of the covers.

The problem of security must also be addressed. Window wells can be a concealed point of access into a dwelling. To prevent this problem, various locks have been devised that secure the window well cover while also being relatively easy to unlock. Unfortunately, when the cover is made easier to lift, it presents a security risk. If the cover is locked down, it presents a safety risk, both with egress and emergency crew ingress. What is needed then is a device that addresses all of these concerns—removing and holding the cover out of the way for safe egress while also minimizing security risk and allowing for emergency ingress.

The present invention is a jack for use with window well covers. The jack is lockable in a stowed position, which serves to secure the window well cover in a closed position, while removable from the outside with the proper tools (usually already in possession of emergency crews) and effort. In use, the jack is unlocked from its stowed position and is easily and intuitively actuated to lift the window well cover with minimal effort. The jack also serves as a brace for the window well cover after it has been lifted.

The present invention represents a departure from the prior art in that the jack of the present invention addresses both emergency egress and security issues associated with window well covers.

SUMMARY OF THE INVENTION

In view of the foregoing disadvantages inherent in the known types of window well cover devices, this invention provides a lockable window well cover jack. As such, the present invention's general purpose is to provide a new and improved window well cover device that is lockable in a secure position, holding the window well cover shut, while also easily unlocked and actuated to remove the window well cover and allow for emergency egress through the window.

To accomplish these objectives, the lockable window well cover jack comprises two hinged arms, a base arm and an actuator handle, and a third support arm hingedly attached to the actuator handle. The base arm depends from the window well ledge and the actuator handle further depends from the base arm and is secured to the window well wall at a locking point. The support arm extends from the actuator handle and is connected to the window well cover. In use, the actuator handle is unlocked and thrust upwards. This then forces the support arm and associated window well cover upwards. When entirely lifted, the arms lock with respect to each other to hold the window well cover ajar and out of the way for escapees to egress through the window. The connection to the window well cover may be broken from the outside, if the cover is a grate type cover, with a standard pair of bolt cutters found in most emergency crew equipment. While this allows access to emergency crews, it is a sufficient deterrent to would-be thieves as most are interested in easy access and do not carry such equipment. In an alternate embodiment, the actuator handle is spring biased to further ease the lifting of the window well cover. It is also an embodiment of the invention to not have the actuator handle lockable, though this counters the goal of security.

The more important features of the invention have thus been outlined in order that the more detailed description that follows may be better understood and in order that the present contribution to the art may better be appreciated. Additional features of the invention will be described hereinafter and will form the subject matter of the claims that follow.

Many objects of this invention will appear from the following description and appended claims, reference being made to the accompanying drawings forming a part of this specification wherein like reference characters designate corresponding parts in the several views.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF THE PREFERRED EMBODIMENT

With reference now to the drawings, the preferred embodiment of the window well cover jack is herein described. It should be noted that the articles "a", "an", and "the", as used in this specification, include plural referents unless the content clearly dictates otherwise.

Figure 1:
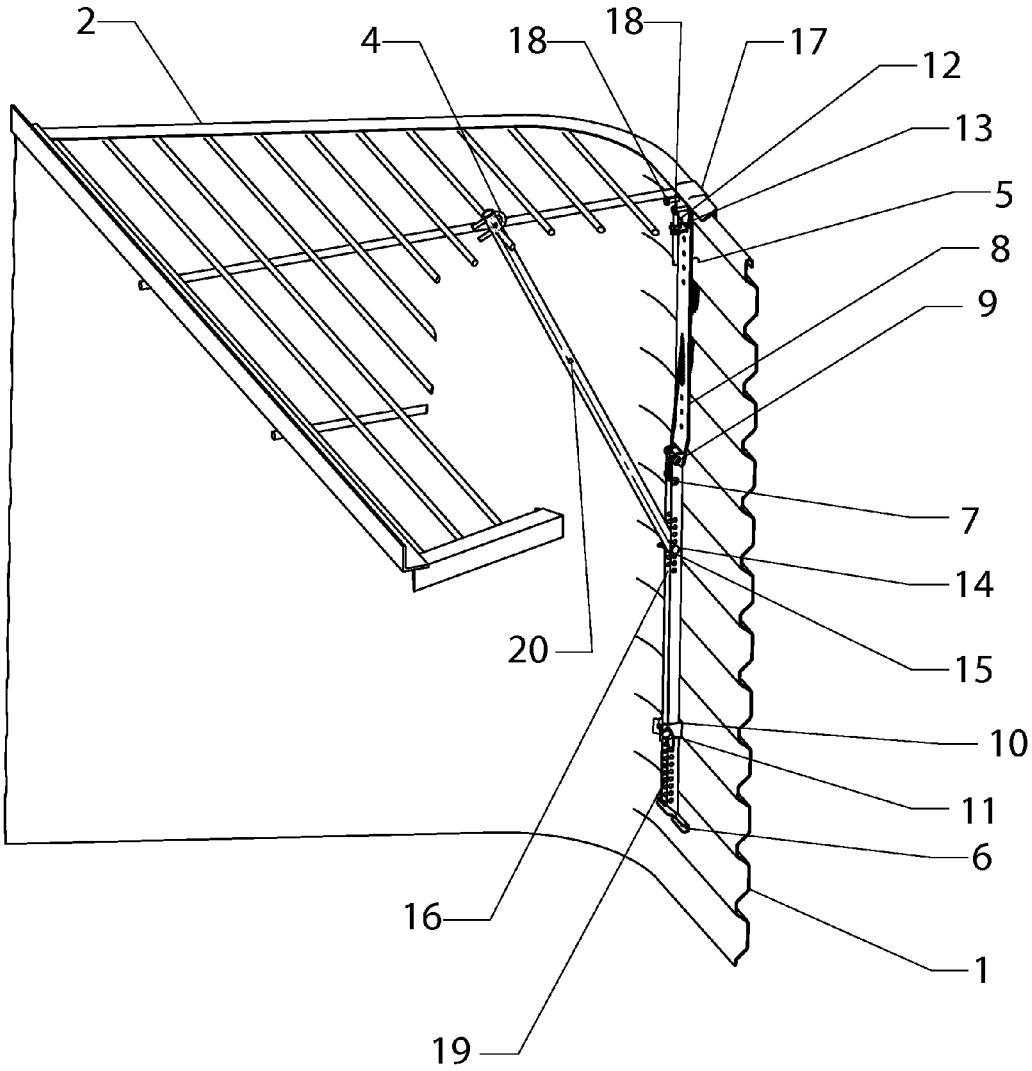
FIG. 1 is a cut away perspective view of a primary embodiment of the window well cover jack, installed and stowed.

With reference to FIG. 1, an embodiment of the invention is shown installed in a window well 1, covered by a grate-type window well cover 2. The depicted jack has a base arm 5 depending from an edge of the window well 1. The base arm 5 is shown to be secured with the bracket support 17 and at least one bolt 18, though any conceivable construction may be utilized so long as it appropriately attached the base arm 5 so it depends from the edge of the window well 1. An actuator handle 6 depends from the base arm 5 and is hingedly attached thereto at joint 9. A support arm 3 is attached to an outer side of the actuator handle 6 and is also secured to the window well cover 2. In the depicted embodiment, this connection is made with the U-bolt 4. However, it should be understood that as there are different types of window well covers, there will also be different methods for securing the jack to the window well cover, ranging from mechanical connectors to adhesives, and the disclosure of this particular attachment method is illustrative and should not be seen as limiting. This particular embodiment is preferred as the U-bolt 4 may be cut with bolt cutters, a usual tool in the possession of rescue crews, so as to free the window well cover 2 from the assembly. However, since intruders are usually interested in quick access and do not carry large, specialized tools, like bolt cutters, the connection with U-bolt 4 is a sufficient deterrent for most purposes. It should be noted that the connection of the support arm 3 to actuator handle 6 is below the hinge joint 9 connecting the actuator handle 6 to the base arm 5.

Figure 3:
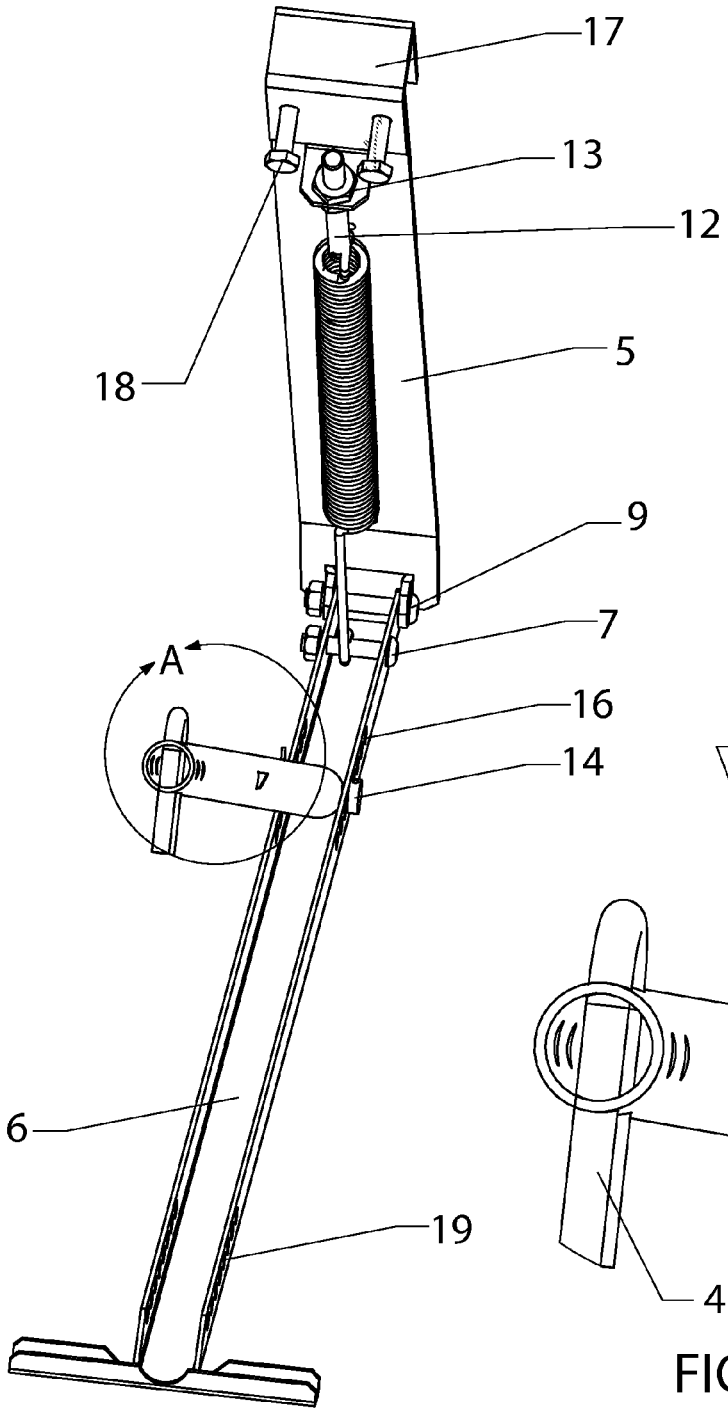
FIG. 3 is an upper perspective view of a window well cover jack.
Figure 5:
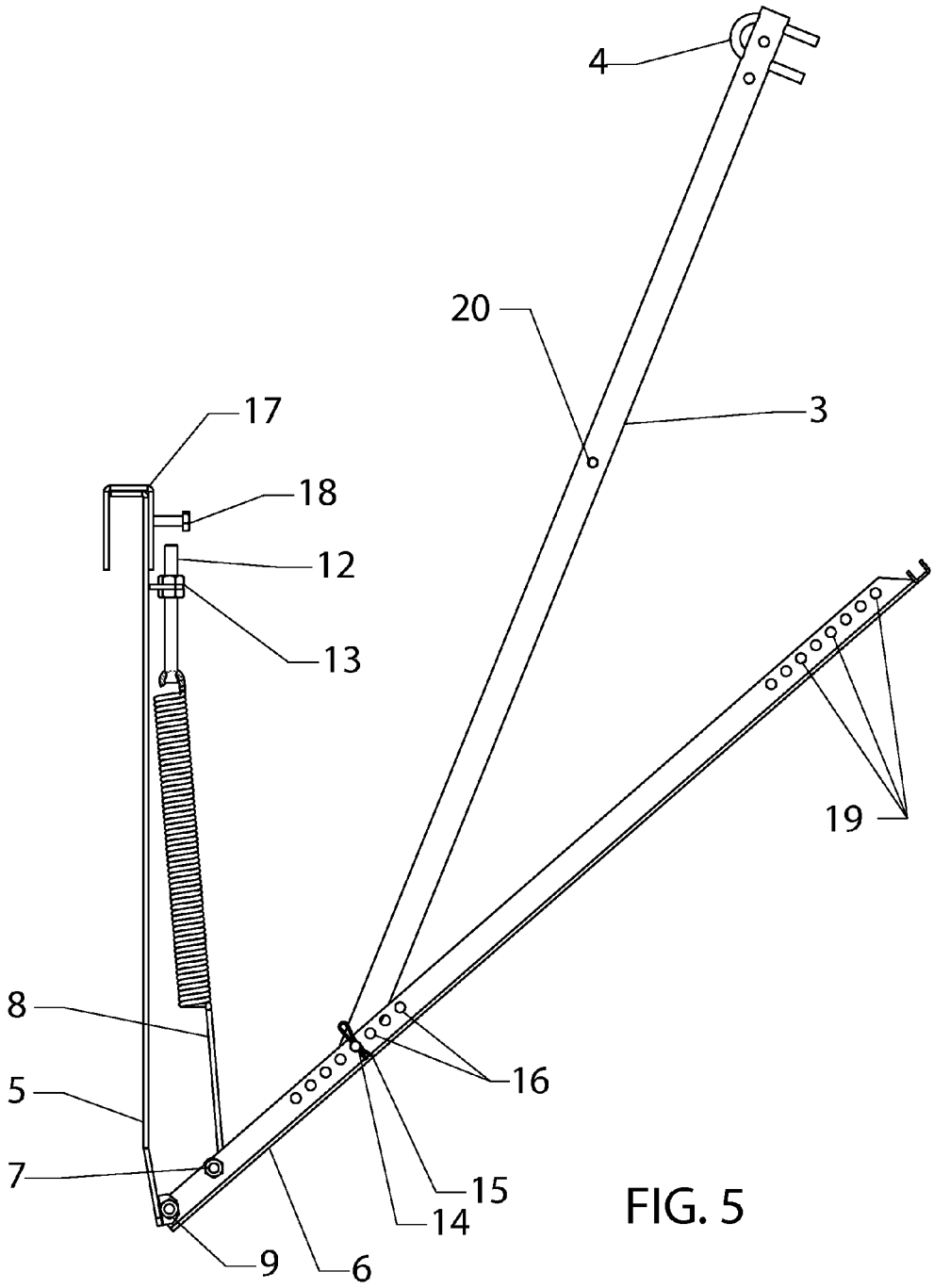
FIG. 5 is a side elevation of the window well cover jack of FIG. 3.

In the depicted embodiment, the actuator handle 6 is secured against the window well 1 at a mounting point, such as spring clip 10 by means of a pin 11. Thus, when need arises, an escapee merely pulls the pin 11 to release the actuator handle 6. This particular embodiment also features an assist spring 8 attached to the actuator handle 6 at bolt 7 and the base arm at bolt 12. Bolt 12 may be adjusted with brace and nut 13 to increase or decrease the tension of assist spring 8, more clearly seen in FIGS. 3 and 5.

Figure 2:
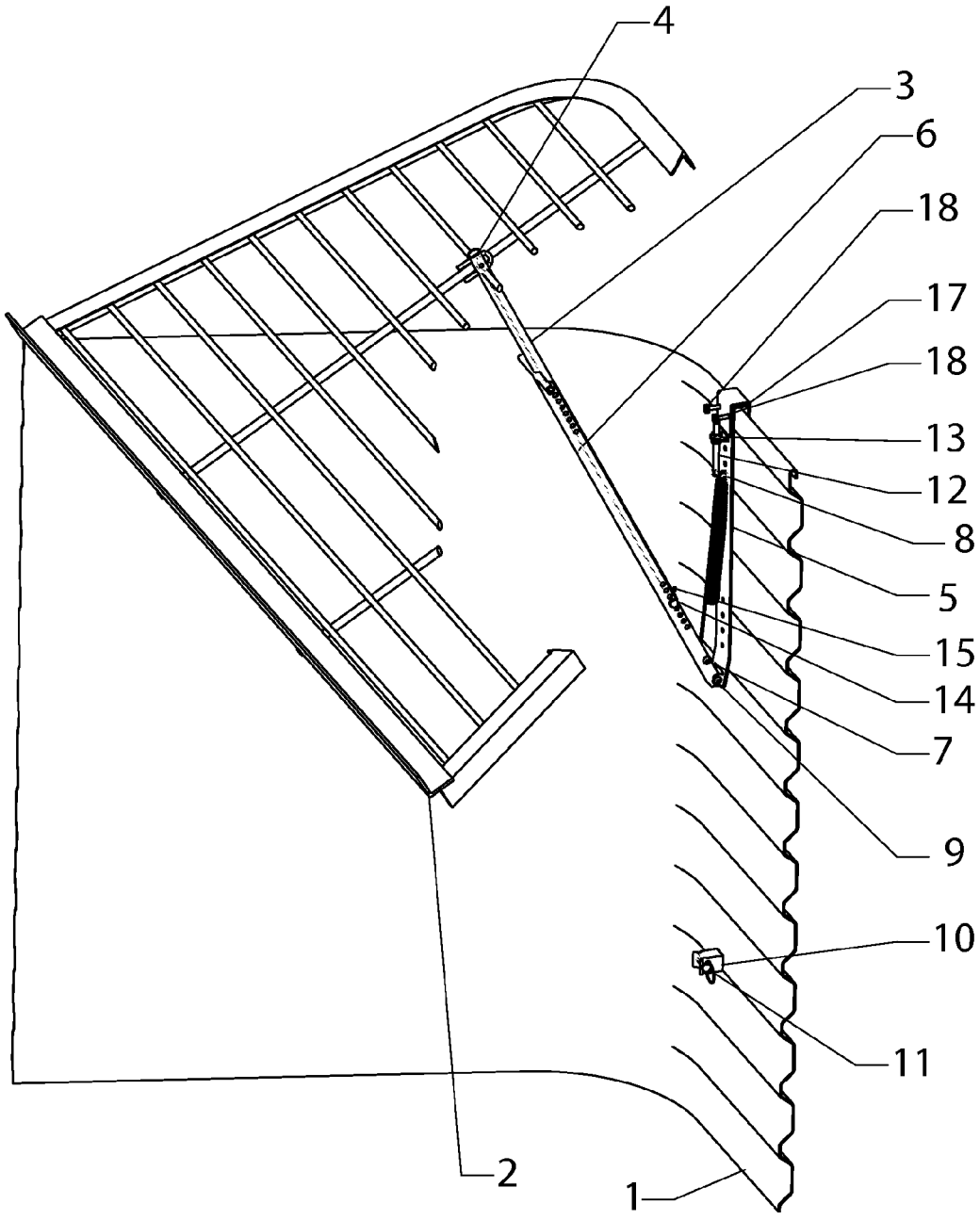
FIG. 2 is the window well cover jack of FIG. 1, deployed.
Figure 4:
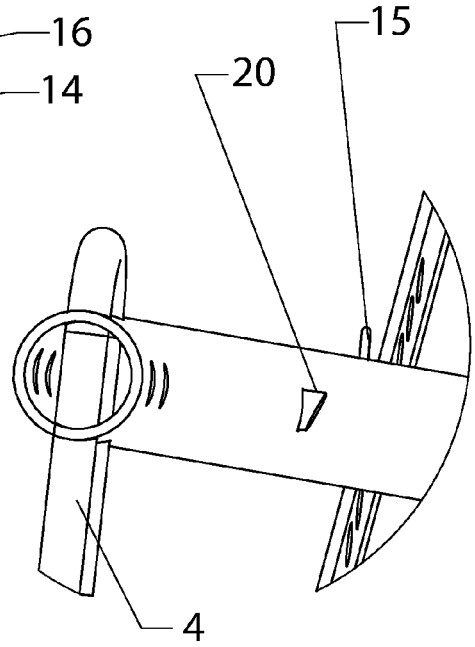
FIG. 4 is a close-up view of the window well cover jack of FIG. 3, taken in circle A.

When deployed, FIG. 2, the spring pin 11 is removed, freeing the actuator handle 6 and allowing it to be pushed upwards. This then forces support arm 3 and the associated window well cover 2 upwards and away from the window well 1. As actuator handle 6 rotates, it will eventually nest support arm 3. At this point, at least one spring pin 20, shown best in FIG. 4, will interface with a provided hole 19 to secure them together. This connection of the two pieces locks the jack in an upwards, deployed configuration and hold the window well cover 2 so that an escapee may egress though the window. As can be readily conceived, while the holes 19 are depicted on the actuator handle 6 and the spring pins 19 on the support arm 3, this is readily reversed.

In the depicted embodiment, the pieces are made to be adjustable to fit a variety of sizes of window wells. This is done through a series of holes 16, into which the support arm 3 may be hinged with a pin 14 and keeper 15, and another series of holes 20 to provide similar adaptability for the locking condition when the jack is deployed, shown best in FIG. 5.

In assembly, then, the user positions base arm 5 over the rim of window well 1 and hangs it there by bracket support 17, secured by bolt(s) 18. The actuator handle is attached at joint 9 and made to rest in spring clip 10, which has already been installed in the window well 1. Support arm 3 is attached to the window well cover 2 (depicted here with U-bolt 4) and a proper hole from the depicted series of holes 16 on the actuator handle is selected. A pin 14 is inserted into the appropriate hole 16 and support arm 3 and secured with keeper 15. The spring bolt 12 may then be tightened or loosened with nut 13 as desired.

Any suitable material may be used, with a preference for light, durable and corrosion resistant materials such as plastics and aluminum.

Although the present invention has been described with reference to preferred embodiments, numerous modifications and variations can be made and still the result will come within the scope of the invention. No limitation with respect to the specific embodiments disclosed herein is intended or should be inferred.

What is claimed is:

1. In combination with a window well and a window well cover, a window well cover jack comprising:

a. a base arm depending from an edge of a window well, the base arm further comprised of a bracket support hooked over and removably attached to said edge of a window well;

b. an actuator handle hingedly attached to the base arm at a pivot and depending therefrom; and c. a support arm hingedly attached along the actuator handle and also attached to a window well cover;

wherein when the actuator handle is lifted, the actuator handle rotates about the pivot, thereby rotating the support arm independent of the window well cover and pushing the support arm and the window well cover upwards until the actuator handle joins with the support arm to form a stable support rod for said window well cover.

2. The window well cover jack of claim 1, the window well jack being lockable in a stowed position.

3. The window well cover jack of claim 2, further comprising a mount on a side of the window well and a removable pin which couples the actuator handle to the mount, thereby locking the window well cover jack.

4. The window well cover jack of claim 1, the window well cover jack being lockable in an open position.

5. The window well cover jack of claim 4, further comprising at least one hole and at least one spring pin that are positioned to mate when the actuator handle is positioned against the support arm when the window well cover jack is deployed.

6. The window well cover jack of claim 1, the support arm being adjustable in relation to the actuator handle.

7. The window well cover jack of claim 1, further comprising an assist spring coupled to the actuator handle, wherein the assist spring aids in movement of the actuator handle.

8. The window well cover jack of claim 1, further comprising a link, securable to the support arm at an end opposite an end connected to the actuator handle, said link designed to secure the support arm to a window well cover grate.

9. A window well cover jack comprising:

a. a base arm;

b. an actuator handle hingedly attached to one end of the base arm at a pivot and depending therefrom;

c. a support arm hingedly attached along the actuator handle; and d. a mount on a side of the window well and a removable pin which couples the actuator handle to the mount, thereby locking the window well cover jack in a stowed position;

wherein the support arm is attached to a window well cover and the base arm depends from an edge of a window well.

10. A window well cover jack comprising:

a. a base arm;

b. an actuator handle hingedly attached to one end of the base arm at a pivot and depending therefrom;

c. a support arm hingedly attached along the actuator handle; and d. at least one hole and at least one spring pin positioned to mate when the actuator arm is positioned against the support arm when the window well cover jack is deployed, thereby locking the window well cover jack in a deployed position;

wherein the support arm is attached to a window well cover and the base arm depends from an edge of a window well.

* * * * *